US008425269B2

(12) United States Patent
Walkowiak

(10) Patent No.: US 8,425,269 B2
(45) Date of Patent: Apr. 23, 2013

(54) MULTI-FUNCTION AUXILIARY RUDDER SYSTEM FOR JET PROPELLED WATERCRAFTS

(76) Inventor: Jeffrey T. Walkowiak, Pinellas Park, FL (US)

( * ) Notice: Subject to any disclaimer, the term of this patent is extended or adjusted under 35 U.S.C. 154(b) by 0 days.

(21) Appl. No.: 13/270,322

(22) Filed: Oct. 11, 2011

(65) Prior Publication Data

US 2012/0285356 A1 Nov. 15, 2012

Related U.S. Application Data

(63) Continuation-in-part of application No. 13/103,154, filed on May 9, 2011.

(51) Int. Cl.
*B63H 11/117* (2006.01)

(52) U.S. Cl.
USPC ..... 440/42

(58) Field of Classification Search ..... D12/317; 114/150; 440/38, 40–43
See application file for complete search history.

(56) References Cited

U.S. PATENT DOCUMENTS 5,167,547 A 12/1992 Kobayashi et al.
6,086,437 A 7/2000 Murray
6,202,630 B1 3/2001 Yip
6,302,047 B1 * 10/2001 Cannon ..... 114/164
6,336,834 B1 * 1/2002 Nedderman et al. ..... 440/43
6,561,858 B1 5/2003 Walkowiak
6,702,630 B2 3/2004 Walkowiak
7,168,996 B2 1/2007 Morvillo

OTHER PUBLICATIONS

Thrust Vector—240/242 10-11 depicted at Web site http:jetboatpilot.com/store/index.php/240-242-series-2010-2011-accessories/thrust-vector . . . (Apr. 18, 2011).

* cited by examiner

*Primary Examiner* — Edwin Swinehart
(74) *Attorney, Agent, or Firm* — Allen, Dyer, Doppelt, Milbrath & Gilchrist, P.A.

(57) ABSTRACT

A rudder system that uses a dual purpose thrust operated actuator. The actuator is selectively positioned for use in an up or constant down mode. While in the up mode, the actuator uses the force of the jet pump to raise the rudders out of the water at speed, and with the actuator set in the down mode, the invention uses the force of the jet pump water to hold the rudder in the water. In an alternative embodiment, the invention includes anti-oscillating veins attached to the thrust operated actuator. In another alternative embodiment, the travel of the actuator is limited by configuring it to come into contact with a rudder stabilizer bar. Another embodiment includes providing adjustable fin positions relative to the side force stabilizer.

15 Claims, 19 Drawing Sheets

"DOWN POSITION"

"INTERMEDIATE POSITION"

"UP POSITION"

MULTI-FUNCTION AUXILIARY RUDDER SYSTEM FOR JET PROPELLED WATERCRAFTS

RELATED APPLICATION

This application is a continuation-in-part application of U.S. patent application Ser. No. 13/103,154 filed May 9, 2011.

FIELD OF THE INVENTION

The invention relates to an auxiliary system for providing positive steering to marine crafts using jet propulsion systems, typically personal jet driven watercrafts such as jet boats and jet skis.

BACKGROUND OF THE INVENTION

By way of background, there are two types of jet propulsion systems currently in use. The first type most commonly used is found on personal watercrafts usually referred to as Jet Skis. This type uses a directional nozzle. The nozzle turns from side to side directing water from the jet to change the direction of the watercraft.

The second type is commonly used on Jet Boats and incorporates a movable hood or cover over the directional nozzle to force the water from the jet below the boat to add reverse thrust and allows the boat to back up. For forward thrust, it is pulled up above the jet nozzle.

In both types, the steering of the watercraft relies completely on the direction and force of the water being expelled from the directional nozzle. This steering method is extremely unreliable as it responds slowly and fails totally if power is reduced or turned off. As a result, there have been many deadly accidents as a result of such watercraft not being able to quickly and positively respond to a need for directional change at any speed, even if engine power is cut off.

In this specification, reference to a directional nozzle drive assembly or system generically includes both of the above types of systems, that is, a directional nozzle by itself or a combination directional nozzle with the reverse thrust hood or cover.

The present invention addresses this steering deficiency currently found in existing watercrafts powered by jet propulsion systems by incorporating an auxiliary keel system to dramatically enhance the steering performance of such watercrafts. In normal operation, the keel steering enhances the watercraft's maneuverability with immediate and controlled response.

In operating conditions where the operator reduces the jet power or stalls the engine, the keel steering takes over and the watercraft will steer accurately. Consequently, the present invention makes the operation of jet propelled watercrafts more enjoyable and, more importantly, much safer.

SUMMARY OF THE INVENTION

The present invention is an auxiliary rudder system configured for use with a jet propelled watercraft having a directional nozzle drive assembly at the stern of the watercraft, or configured for use with a jet propelled watercraft having a directional nozzle drive assembly at the stern of the watercraft and a movable hood that rotates over a directional nozzle to downwardly direct and force water from the directional nozzle below the watercraft for providing reverse thrust. In either case, the invention attaches to the directional nozzle drive assembly at the stern of the watercraft.

The embodiments of the present invention described herein provide for the versatility of operating as a rudder assisted steering in power or reduced power mode, that is, slow or idle speeds, or the invention can be set to provide rudder assistance to the steering at all speeds. In either case, the rudders are capable of being deflected up if they contact a submerged object while the boat is moving or anchored.

To provide this multi-functional operation, the invention uses a dual purpose thrust operated actuator, wherein the actuator may be set in an up mode, a lower mode and the modes may be selectable, or in a fixed non-selectable mode pre-set for up or down mode only. While in the up mode, the actuator uses the force of the jet pump to raise the rudders out of the water at speed, and with the use of one or more articulating or bias means, for example, spring(s) or cable(s) configured to contact with one of the rudders or be attached to one of the rudders, to deploy the rudders down at slow or idle speed to provide needed steering assistance to the operator. The actuator is set to capture water being expelled by the jet pump and as the thrust increases the rudders lift out of the water gradually decreasing their influence to the boat handling, up to the final position where they have no influence at speed meeting the individual needs or desires of the boat operator. The articulating or bias means may further incorporate means for adjusting the tension of any spring(s) or cable (s). Such tensioning devices are known in the art and are easily provided to adapt to the articulating or bias method chosen, whether the preferred spring or alternative cable or any other suitable method.

With the actuator set in the down mode, the invention uses the force of the jet pump water to hold the rudder in the water. As the boat increases speed the pump also increases thrust. The rudders are held down as the water flows on top of the actuator, which is essentially close to or approximately located on a plane more or less aligned with the bottom of the nozzle opening. The thrust of the water exiting the nozzle opening maintain the actuator down, thereby also keeping the rudders in the down position for enhanced steering. The back-up springs or other equivalent articulating or bias means are utilized in the event of power loss or reduced pump thrust due to clogging of the jet with weeds and other possible obstructions to the jet pump. However, in normal operation, the articulating or bias means do not function due to the downward force of the jet pump. This will greatly reduce spring fatigue and increase the reliability of the auxiliary rudder system.

In the down mode, the rudders will provide enhanced steering response, feedback to the operator through the helm, better control for handling rough water conditions. Further, the boat will maintain high speed turns while reducing speed. This is something jet steering will not do by itself. Conventional jets will immediately lose their turning ability if the engine power is reduced dramatically while making a turn. Further, the boat would perform better at towing tubes and skiers.

The spaced-apart rudders are typically configured to be mounted to the outside of an original equipment manufacturer directional nozzle housing. When nozzle reverse hoods are installed on the existing nozzle assembly, then the rudder system may be configured to be installed such that the rudders are either on the outside the nozzle/reverse hood assembly or the rudders can be configured to be installed between the nozzle and the reverse hood, depending on the practicality of the overall design of the nozzle/reverse hood assembly. For purposes of illustration only, the rudders will be depicted in the below described drawings on the outside.

The down mode will also provide assistance to the operator while making turns at high speed by reducing the force needed to turn the helm. This is due to external side forces being placed on the rudders as the boat turns at speed.

In the present invention a side force stabilizer is placed between the spaced-apart rudders. The stabilizer is attached to the existing nozzle housing below its exit opening. It serves as means for transferring the force to the steering helm and to prevent the rudders from bending due to the side forces.

Conventional jet steering becomes quite difficult at speed due to internal side forces from the high pressure water jet striking the inner wall of the steering nozzle as it tries to re-direct the water jet to turn the boat. With the rudders deployed at speed, external forces build up on the rudders as they are pushed through the water sideways. These forces counteract the internal forces and reduce the physical strength required to turn the helm. The end result is a power steering effect.

The present invention may also incorporate one or more anti-oscillation veins placed on the actuator as necessary to eliminate oscillation of the steering unit as it rides in or on the high pressure jet of water exiting the jet pump nozzle. These veins may be added to the top, bottom or both sides of the actuator as needed to obtain the required results, although the preferred location is on the bottom surface. This added stabilization is important especially when the steering unit is set to ride on top of the jet stream as the parts can build up a violent harmonic vibration caused by thousands of swirling pulsations in the exiting jet of water. Generally, the fins serve as anti-oscillation veins but when the fins are up, the veins assist the fins and provide an anti-oscillation functional feature. This vibration has been reported to cause serious issues with the operation of the boat and is suspected of causing damage to adjacent parts of the pump as well.

Another embodiment includes a variation for the stops where it is built in to the side force stabilizer and the actuator so that they meet at points for the fins to rest against when the set is in the down mode. The actuator itself would be configured to interact with the stabilizer and serve as a stop in lieu of using a boss as described above. On example of a configuration is providing the actuator with an extended portion at each end or at the edge near the fins and the side force equalizer could have points (although such points are necessary) going up at the end to make contact with the actuator and act as a set of stops for the fins to come to rest on when in use in the down function.

In another embodiment, a set of variable effect rudders, using a fixed position side force stabilizer and several graduating mounting holes on the fins that allow the consumer to vary the amount of steering assistance they receive. From full assistance with the fins all the way down, they will get both high speed and slow speed assistance. With the fins part way down they get less assistance in high speed and with the fins all the way up, they only get low speed assistance. This system can use a number of positioning holes so they can fine tune the results they desire, without having to modify the system. In this variant of the invention, the auxiliary rudder system comprises a pair of spaced-apart fins, the fins being configured to be attached at one end to a proximal end of the nozzle drive system so that the fins are oriented along sides of the nozzle drive system. The fins extend in length from the proximal end of the nozzle drive system a predetermined distance beyond a jet water flow outlet of the nozzle drive assembly. A side force stabilizer member is configured to be fixed to an underside of the directional nozzle of the nozzle drive system. The stabilizer member is oriented transversely such that respective ends of the stabilizer member are attached to the inside surface of the fins. The fins are selectively attachable to the stabilizer member ends such that the fins are positioned in an "up" position, a "down" position and one or more intermediate positions relative to the stabilizer member.

DETAILED DESCRIPTION OF THE INVENTION

Figure 1:
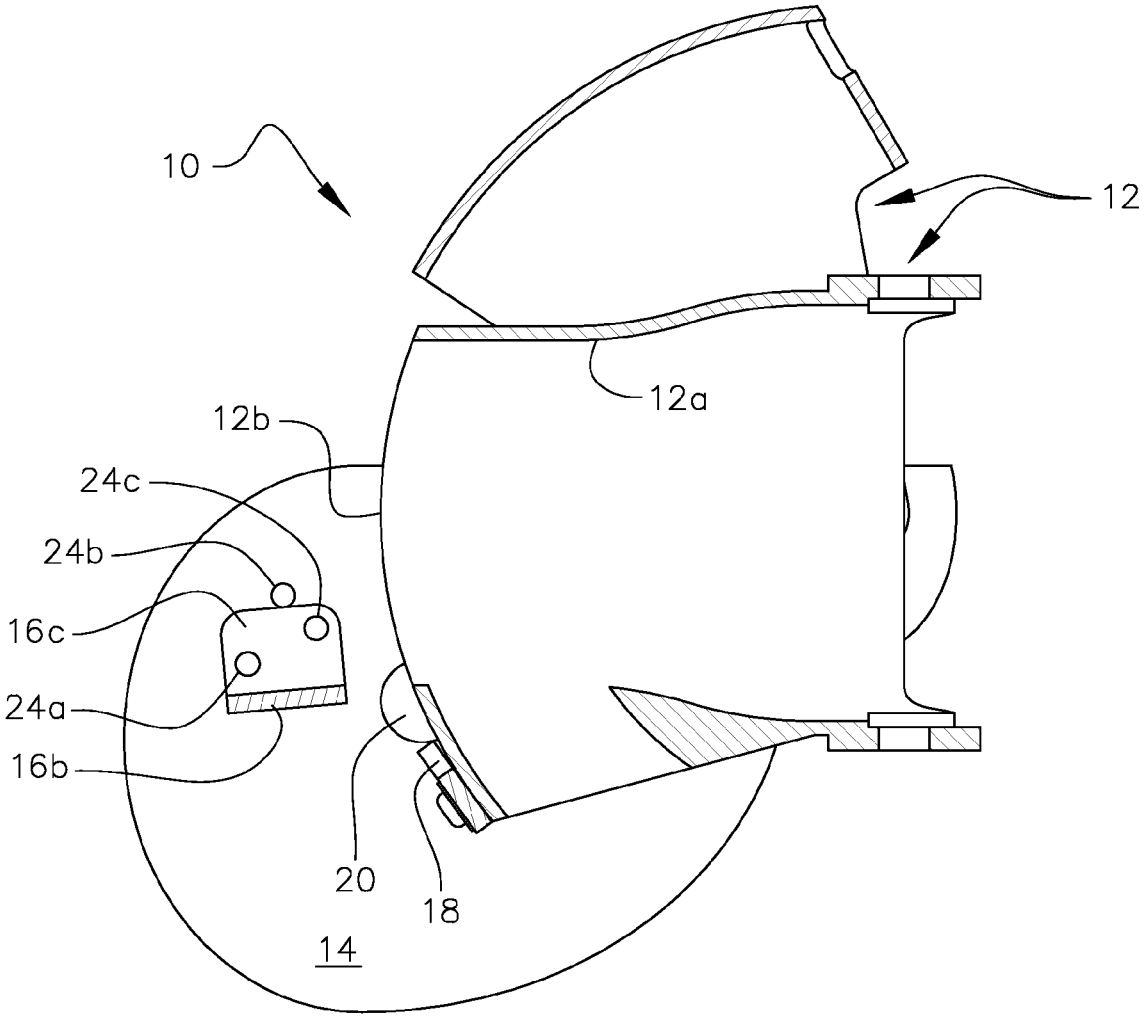
FIG. 1 is a cross-sectional conceptual view of the present invention with the hood lifted out of the way and the actuator member in position 2, that is, the lower positioning aperture being utilized on the bent portion of the actuator member to allow exiting water to flow over the actuator member upper surface.
Figure 2:
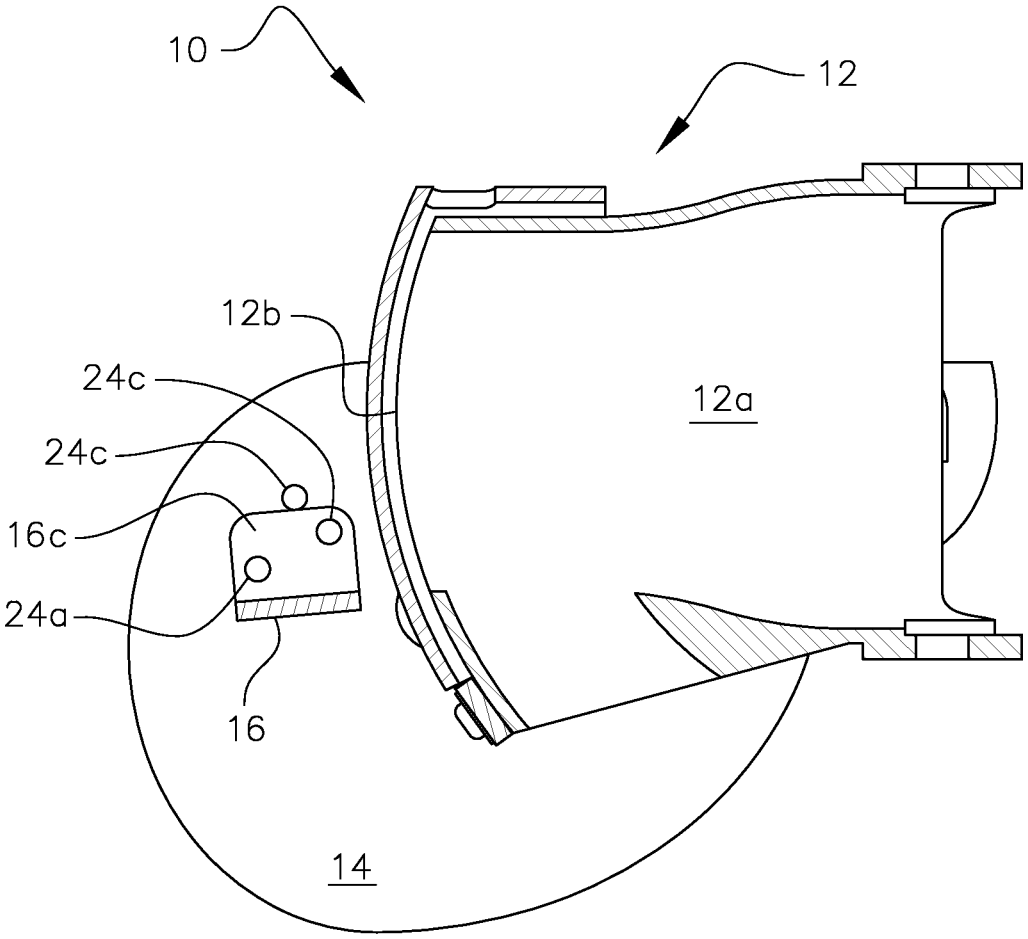
FIG. 2 is a representational cross-sectional view of FIG. 1 with the hood of the nozzle drive system lowered.
Figure 3:
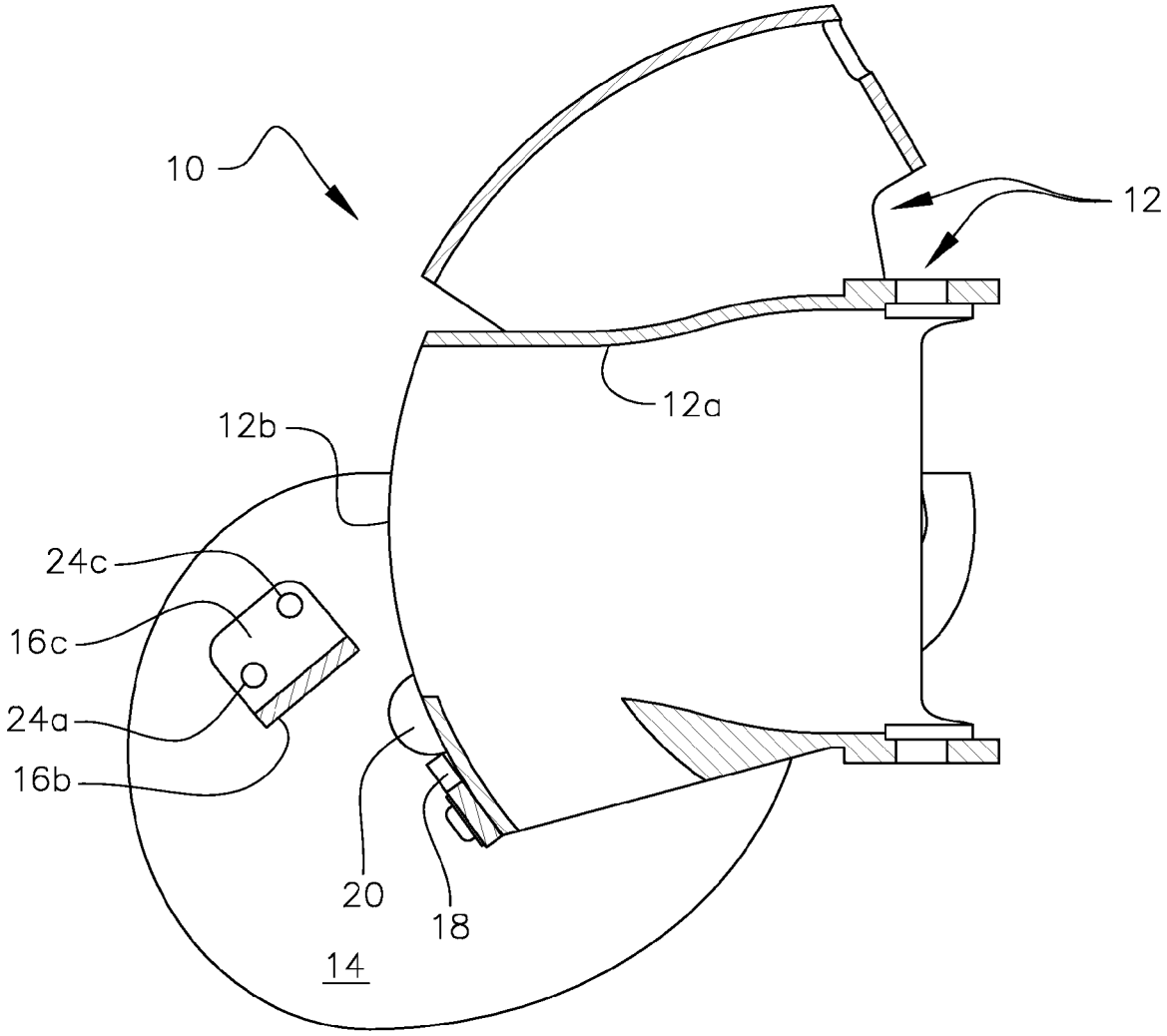
FIG. 3 is a is a cross-sectional conceptual view of the present invention with the hood lifted out of the way and the actuator member in position 1, that is, the upper positioning aperture being utilized on the bent portion of the actuator member to allow exiting water to flow partially under the actuator member.
Figure 4:
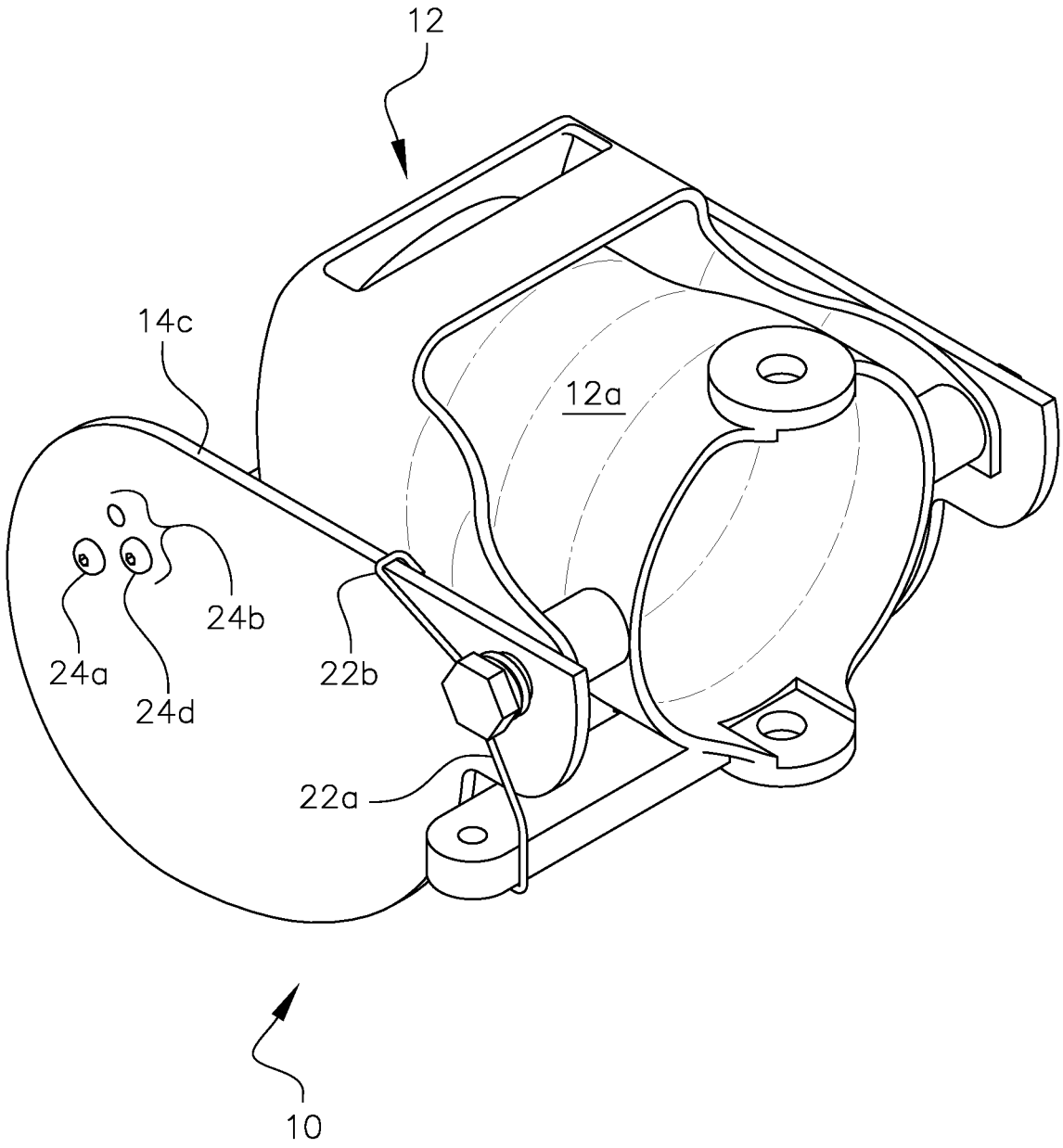
FIG. 4 is a perspective rear view of the present invention with the hood down over the outlet and the fins in a down position.
Figure 5:
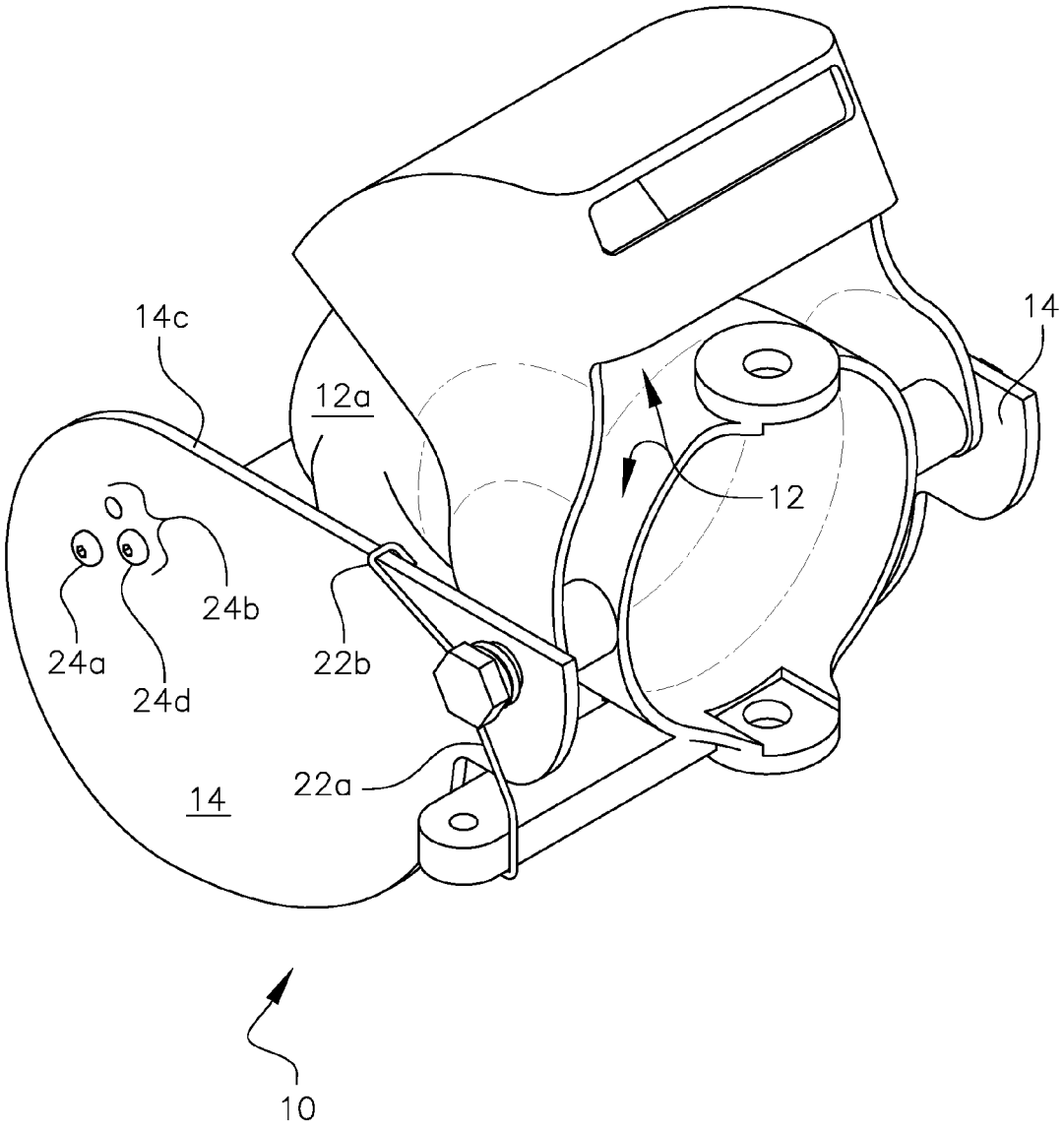
FIG. 5 is a is a perspective rear view of the present invention with the hood up over the outlet and the fins in a down position.
Figure 6:
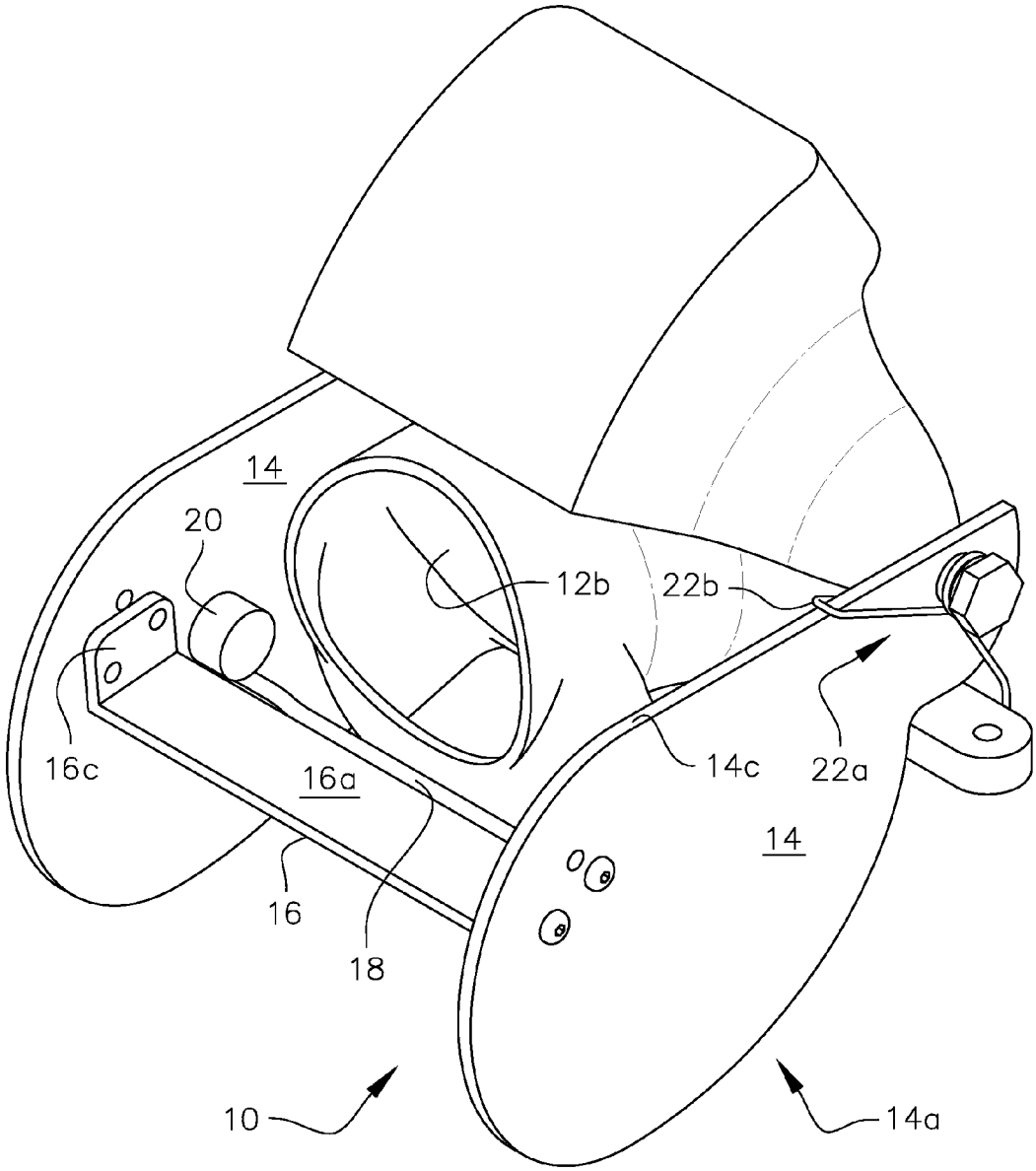
FIG. 6 is a perspective view of the present invention looking toward the outlet with the hood up and the fins down.
Figure 7:
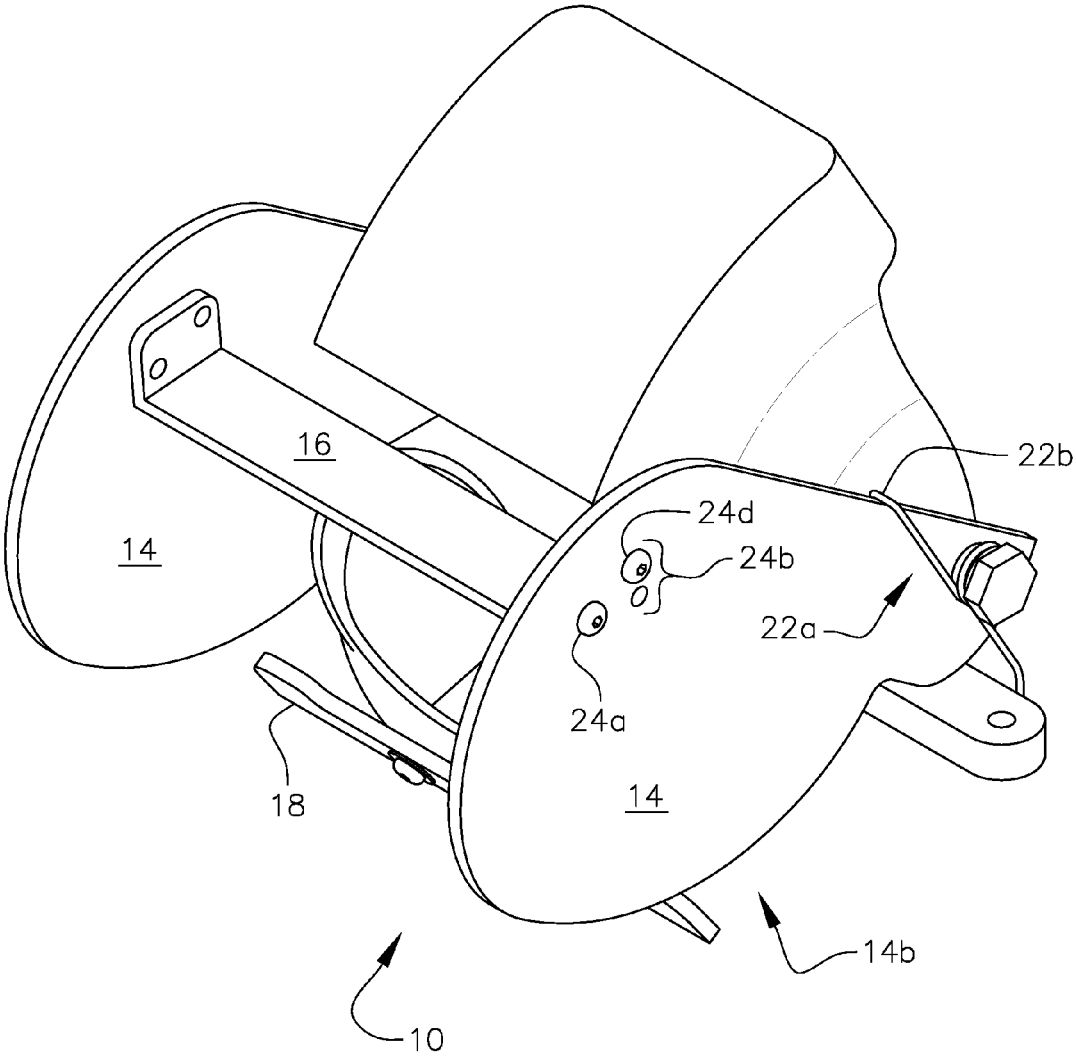
FIG. 7 is a perspective view of the present invention looking toward the outlet with the hood up and the fins up.
Figure 8:
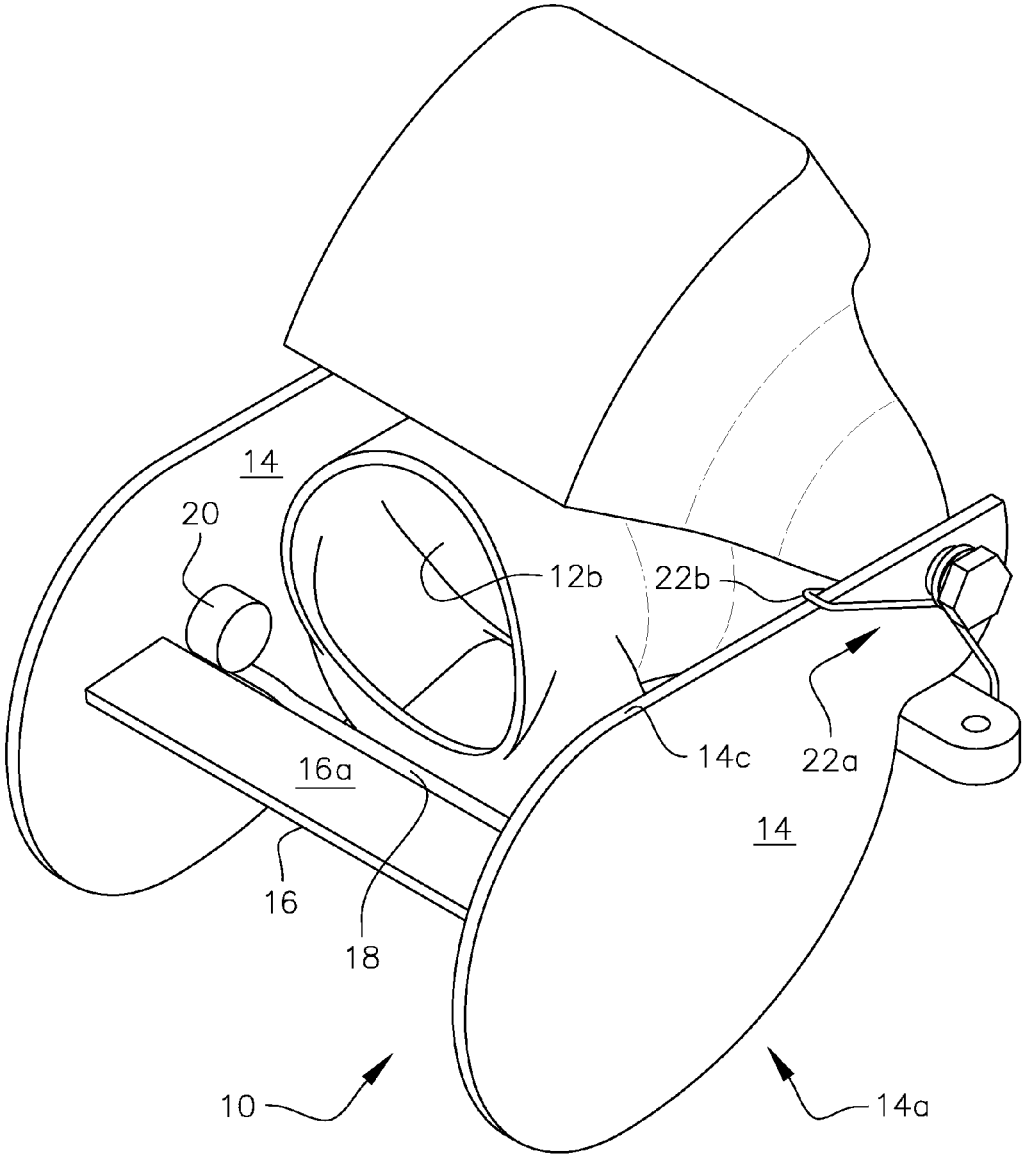
FIG. 8 is a view similar to that of FIG. 6 except with the actuator being pre-set and fixed to the sides of the fins.
Figure 9:
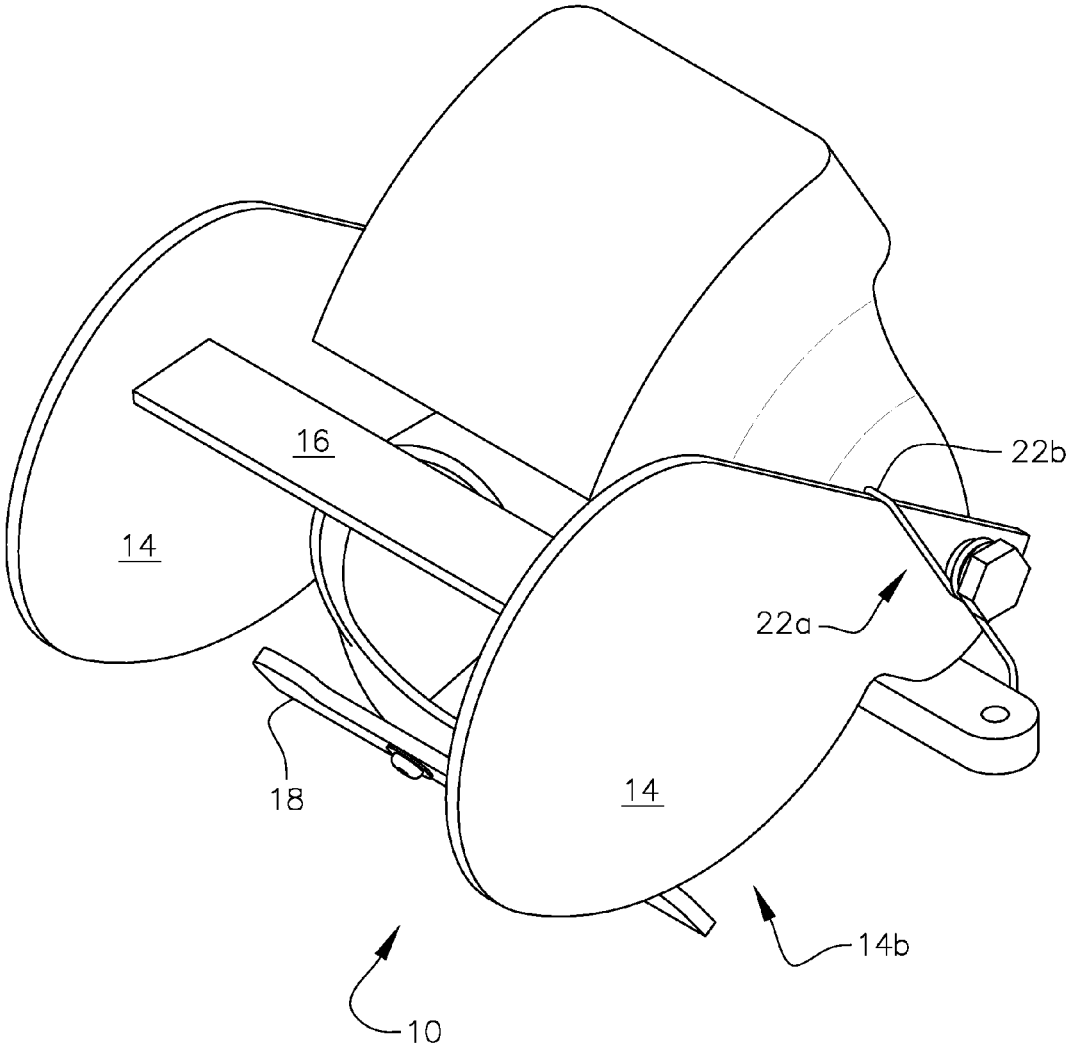
FIG. 9 is a view similar to that of FIG. 7 except with the actuator being pre-set and fixed to the sides of the fins.
Figure 10:
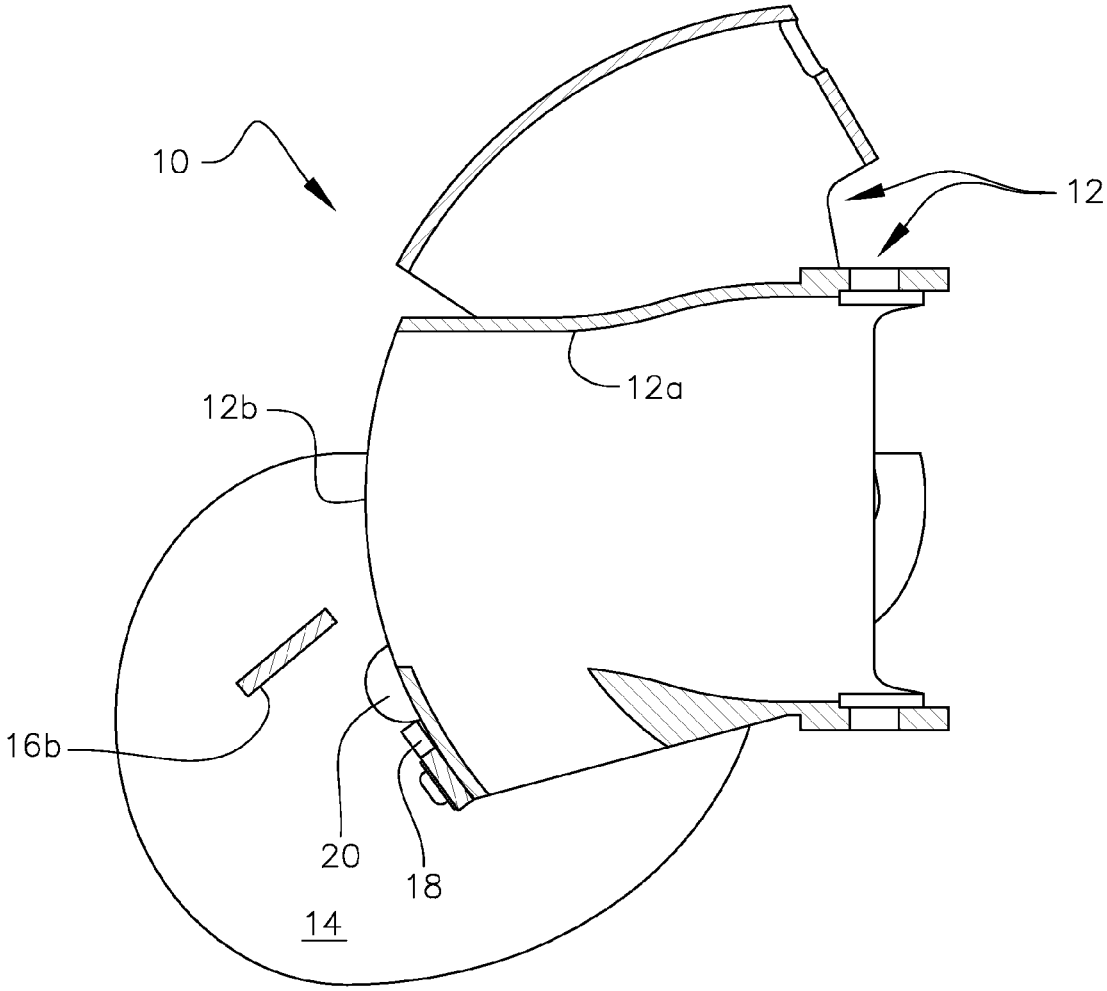
FIG. 10 is a view similar to that of FIG. 3 except with the actuator being pre-set and fixed to the sides of the fins.
Figure 11:
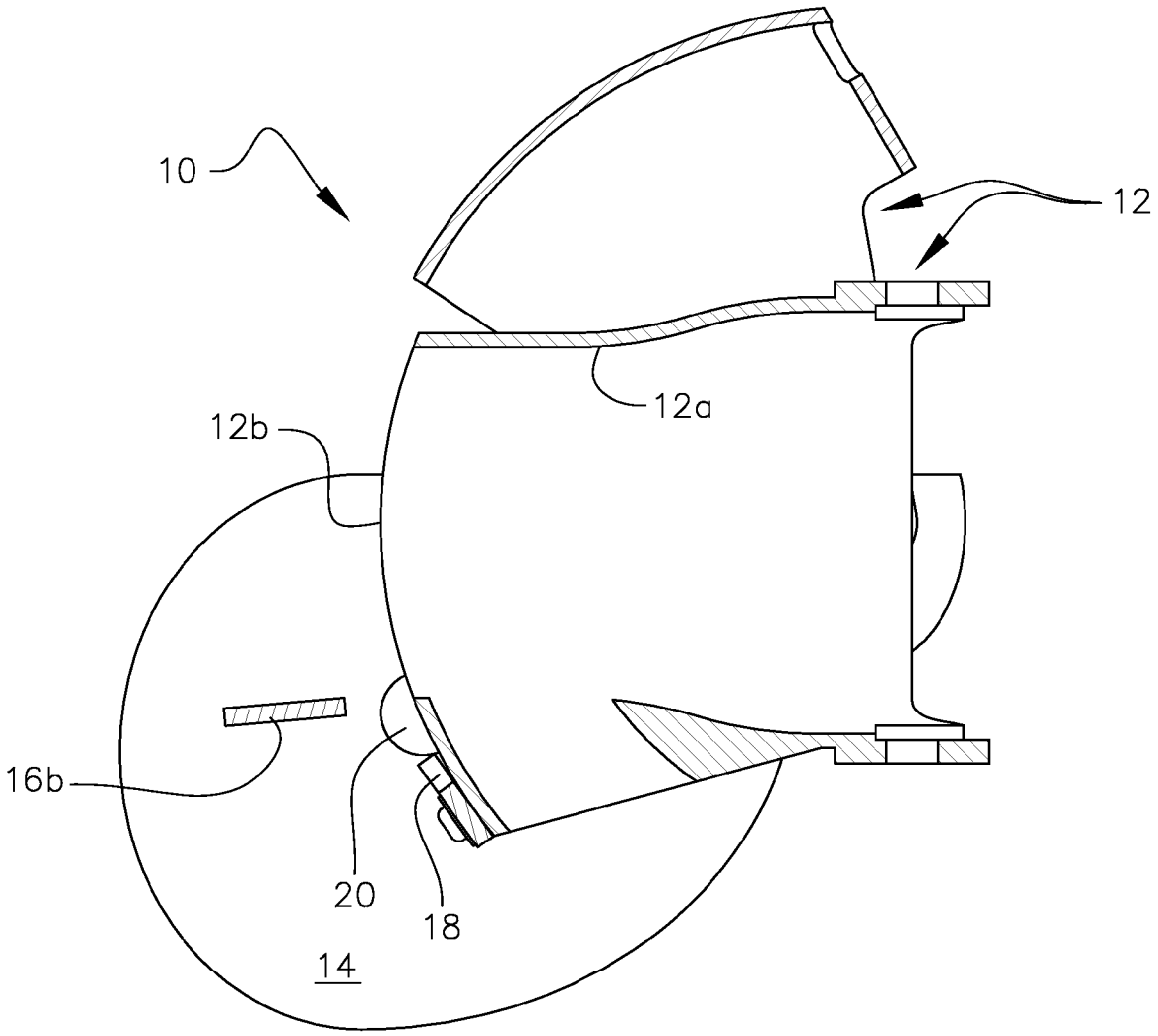
FIG. 11 is a view similar to that of FIG. 2 except with the actuator being pre-set and fixed to the sides of the fins.

Referring now to the drawings, FIGS. 1-11 conceptually disclose the present invention, which is an auxiliary rudder system configured for use with a jet propelled watercraft having a directional nozzle drive system 12. The directional nozzle itself is depicted as 12*a* and its outlet is depicted as 12*b*. The rudder system is depicted generally as 10.

The auxiliary rudder system 10 comprises a pair of spaced-apart fins 14. The fins 14 are configured to be pivotally attached at one end to a proximal end of said nozzle drive system 12 so that said fins 14 pivot up or down along sides of said nozzle drive system 12. The fins 14 extend in length from said proximal end of said nozzle drive system 12 a predetermined distance beyond a jet water flow outlet 12*b* of the directional nozzle 12*a* of the drive assembly 12. The length beyond the outlet plane is sufficient to include the dual thrust actuator 16 between the fins 14 and to also subject the actuator surfaces 16*a*,16*b* to thrust forces from the water flow exiting the nozzle outlet 12*b*.

The invention further includes a thrust operated actuator 16. Each end of the actuator is removably attached or optionally permanently fixed to an inside surface of the fins 14. The actuator 16 further has respective top and bottom surfaces 16*a*,16*b*, and is dimensioned and configured to be subjected to a thrust force caused by a flow of water exiting the outlet 12*b* of the directional nozzle.

In one embodiment when the permanent fixed installation of the actuator 16 is not desired, the actuator 16 may further comprise opposing bent portions 16*c* at each end of the actuator 16. Each of the bent portions 16*c* are in contact with a respective inside surface of the fins 14. The bent portions 16*c* are attached to the inside surfaces of the fins 16. They can be attached with or without a pivoting feature, for example, if the actuator 16 is intended to be oriented to stay in a down position at speed or if the actuator 16 is intended to be oriented so as to lift the fins 14 at speed as water flows partially under the bottom surface of the actuator 16. Of course, the bent portions 16*c* can pivotally attached to the fins 14 to provide for dual purpose operating characteristics, as further described below. The bent portions 16*c* shown in the drawings are depicted to be vertically oriented in an upward direction however it is understood that they may be vertically oriented in the downward direction as well.

The bent portions 16*c* further have means 24 for pivoting and positioning the actuator orientation such that the top surface 16*a* of the actuator 16 is constantly subjected to a thrust force of water exiting the nozzle outlet 12*b* to keep the fins 14 in a down position at any speed or for pivoting and positioning the actuator orientation such that a bottom surface 16*b* of the actuator 16 is at least partially subjected to the thrust force of water exiting the nozzle outlet 12*b* to lift the fins 14 in an up position at an operating speed. This can be done in a number of ways. The pivoting feature can be a rotatable rivoted or fastened pivot point 24*a* in which the actuator bent portions 16*c* are pivoted attached to the fins 14. Then two apertures 24*b* can be provided on the fins 14 and an additional aperture 24*c* can be provided on the bent portions 16*c* through which a removable pin or fastener 24*d* may be inserted and passed through one of the two apertures on the fins 14. Each aperture represents a position 1 for allowing for partial flow of exiting water to pass under the actuator 16 and position 2 to for allowing the water flow above the top surface of the actuator 16. Other means not depicted may include two slots on each fin where the fins can be partially disassembled (spread out) and the ends of the actuator may be placed in corresponding slots to provide for the up or down performance characteristics described above.

A side force stabilizer member 18 is configured to be fixed to an underside of a directional nozzle 12*a* of the nozzle drive system 12. The stabilizer member 18 is oriented transversely such that respective ends of the member 18 are located juxtaposed the inside surface of the fins 14 when the fins 14 are in a down position.

The invention further includes fin rotation stop means 20 for limiting a rotation downwardly of the fins 14. This can be done in a number of ways such as providing various ridges or protrusion from the inside surface of at least one of the fins 14 or by having a portion of the side force stabilizer member configured to extend below the fins 14 to that as the fins are lowered, the bottom edge of the fins come in contact with the stabilizer member 18 extended end. This example is not shown in the drawings. A preferred embodiment is to include the former example, that is, a boss member 20 attached to an inside surface of one of the fins 14 and located so as to contact the side force stabilizer member 18 when the fins 14 are rotated downwardly.

The invention further comprises bias means 22*a* for holding the fins 14 in the down position. The bias means 22*a* are configured and tensioned to allow the fins 14 to lift in an up position when an object is struck by the fins 14. In a preferred example of such bias means, at least one spring 22*a* is provided that has an extended end 22*b* which is in contact with a top edge 14*c* of one of the fins 14.

The inventive rudder system components can be made from a variety of materials, including stainless steel, aluminum, bronze/brass materials, polymeric composite materials or many other suitable materials sufficient for the environment in which such watercrafts are used.

Figure 12:
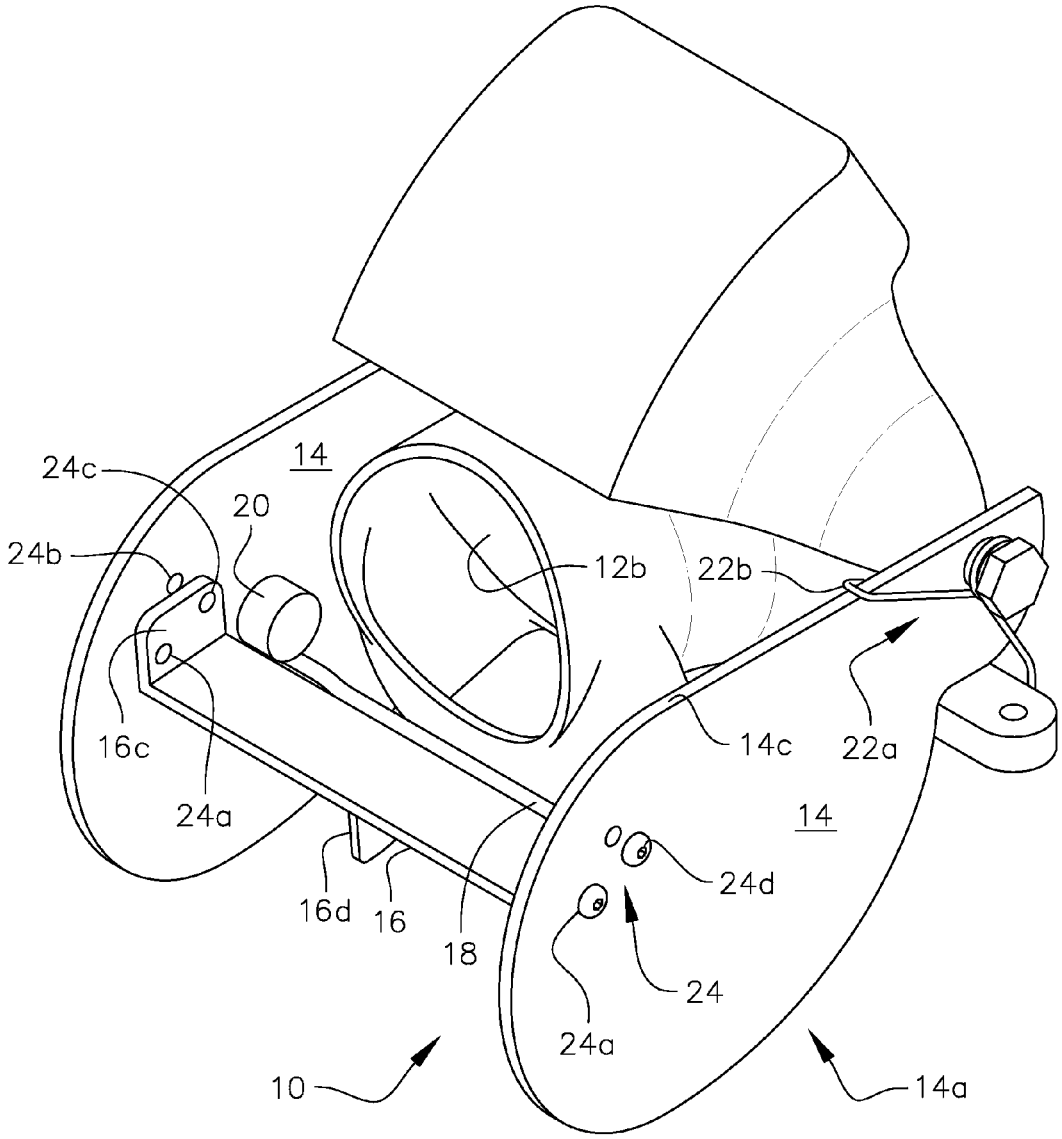
FIG. 12 is a perspective view of the present invention looking toward the outlet with the hood up and the fins down with an added feature of the anti-oscillating veins, in this case, a single vein added to the actuator.
Figure 13:
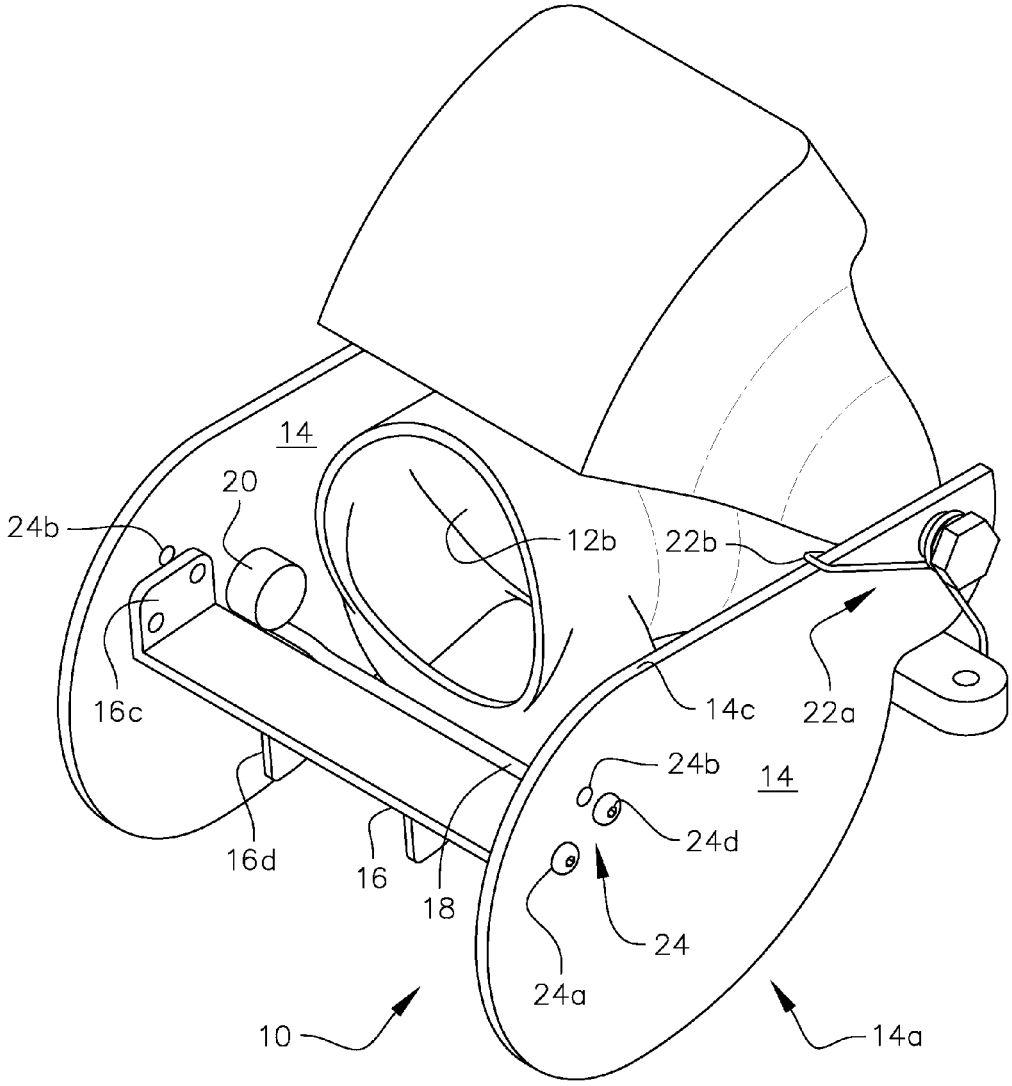
FIG. 13 is a depiction similar to FIG. 12 except the depiction of multiple veins, in this case, two veins added to the actuator.
Figure 14:
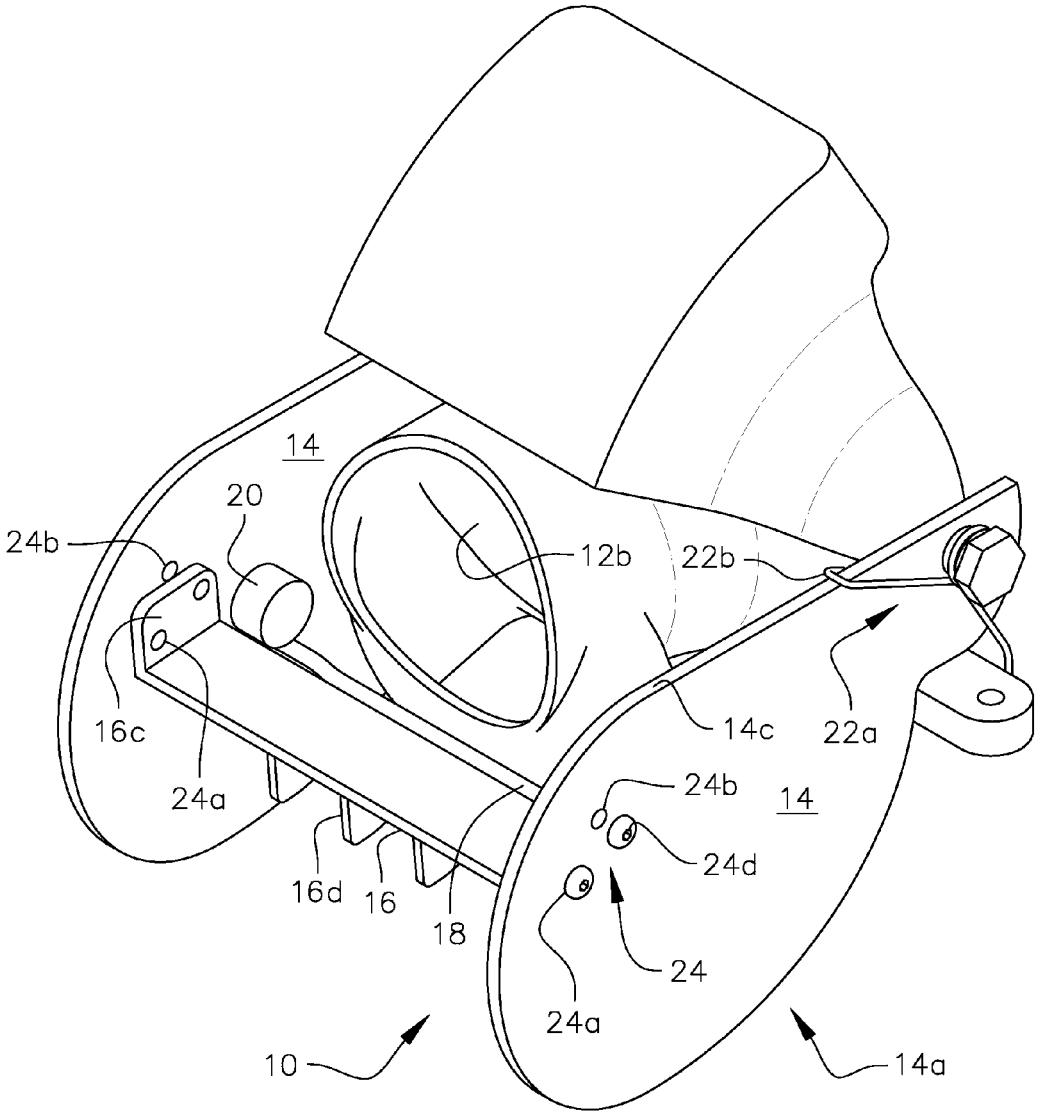
FIG. 14 is a depiction similar to FIG. 12 except the depiction of multiple veins, in this case, three veins added to the actuator.

The present invention may also incorporate one or more anti-oscillation veins 16*d* placed on the actuator as necessary to eliminate oscillation of the steering unit as it rides in or on the high pressure jet of water exiting the jet pump nozzle. FIGS. 12-14 depict the veins 16*d* under the actuator 16. These veins 16*d* may be added to the top, bottom or both sides of the actuator as needed to obtain the required results, although the preferred location is on the bottom surface. This added stabilization is important especially when the steering unit is set to ride on top of the jet stream as the parts can build up a violent harmonic vibration caused by thousands of swirling pulsations in the exiting jet of water. This vibration has been reported to cause serious issues with the operation of the boat and is suspected of causing damage to adjacent parts of the pump as well.

Figure 15:
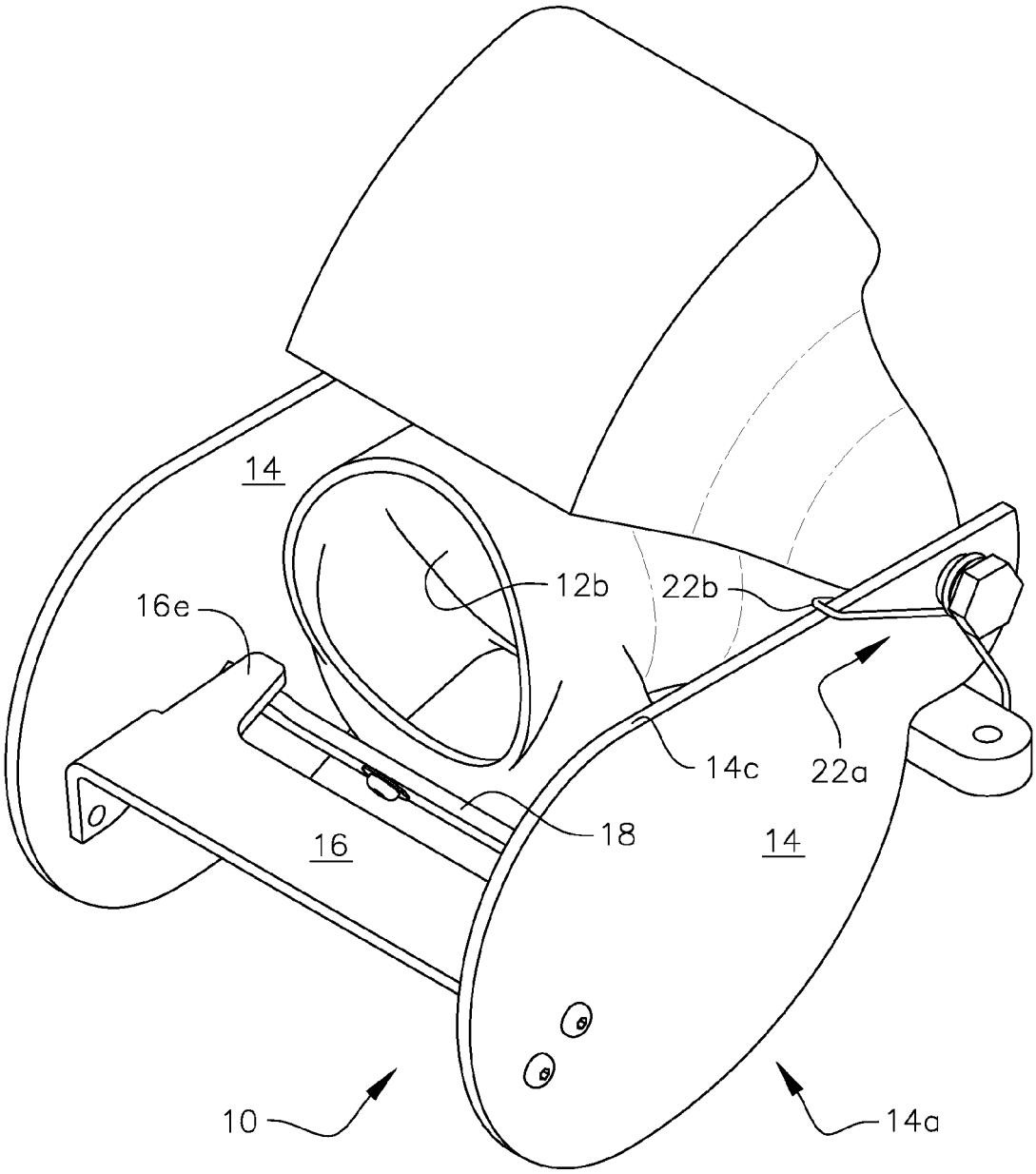
FIG. 15 is a depiction of another embodiment of the invention wherein the actuator is configured to contact with stabilizer to stop the travel of the fins.
Figure 16:
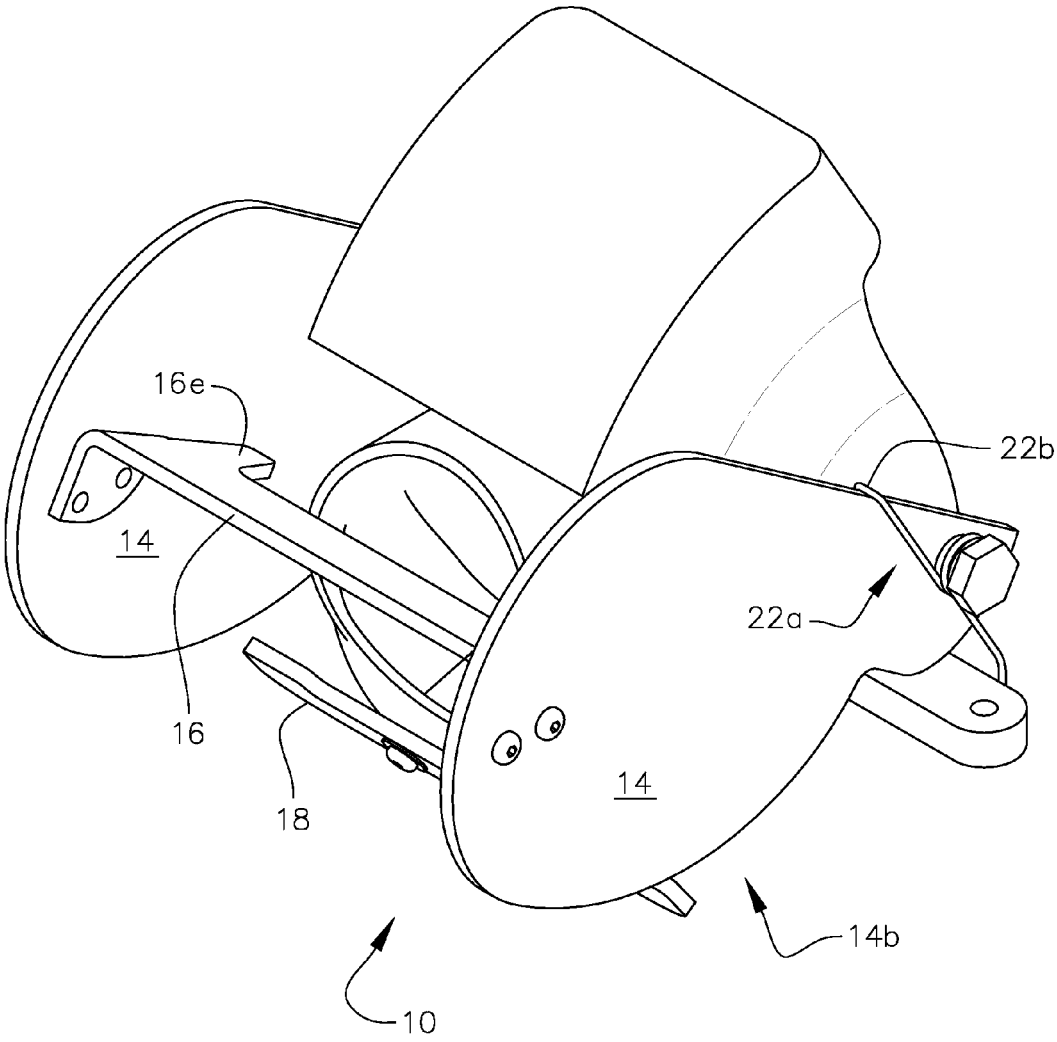
FIG. 16 is a depiction of the embodiment of FIG. 15 with the actuator separated from contacting the stabilizer.

Another embodiment depicted in FIGS. 15-16 includes a variation for the stops 20 discussed above. In this embodiment, stop 16*e* is provided. That is, the actuator 16 is configured so that the actuator 16 directly interacts with stabilizer 18 by coming in contact with the stabilizer 18. The actuator itself would be configured to interact with the stabilizer and serve as a stop in lieu of using a boss as described above. One example of a configuration is providing the actuator with an extended portion at each end or at the edge near the fins and the side force equalizer could have points (although such points are necessary) going up at the end to make contact with the actuator 16 and act as a set of stops 16*e* for the fins to come to rest on when in use in the down function.

Figure 17A:
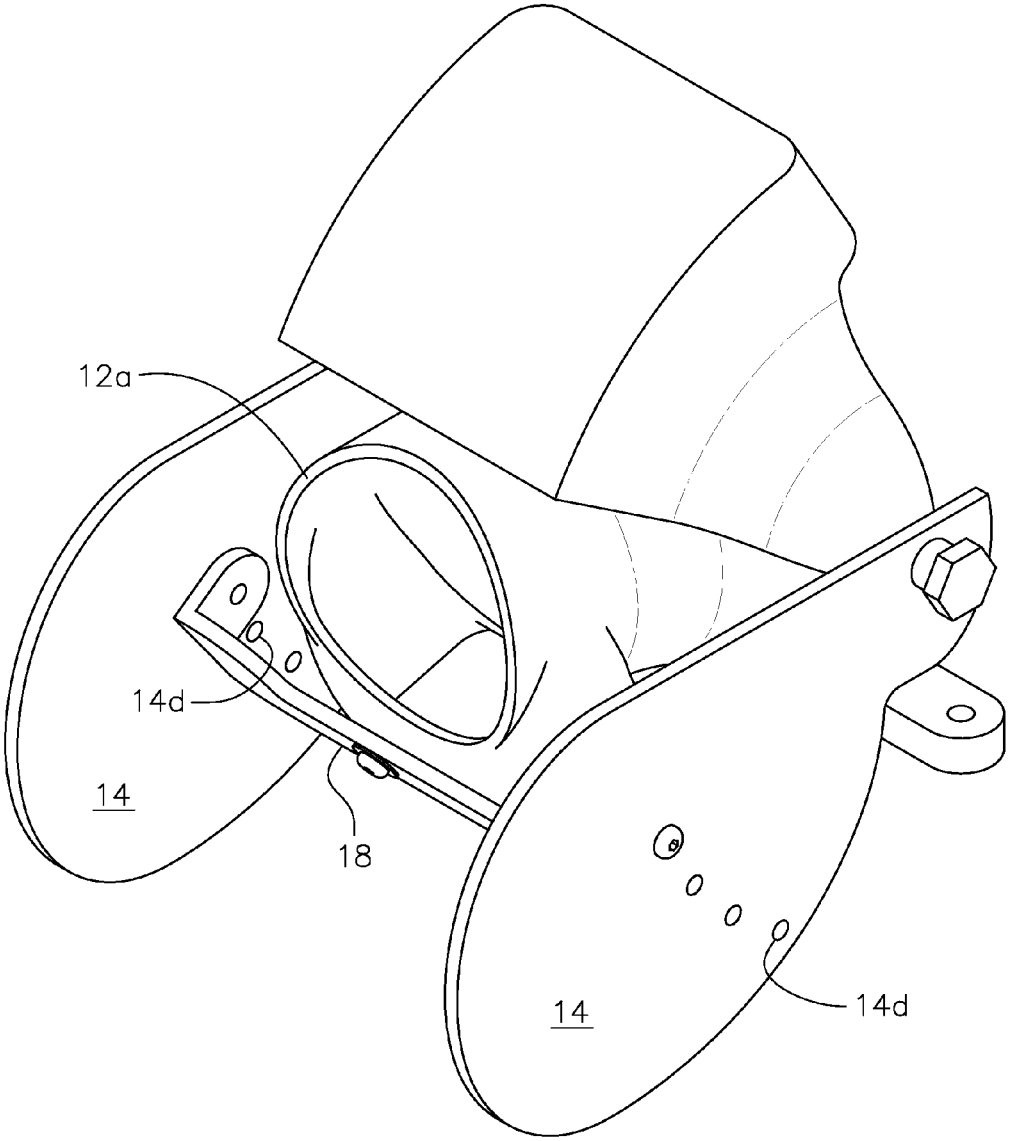
FIG. 17A is a conceptual depiction of another variant of the present invention where the fins are attached directly to the ends of the stabilizer member, in this case, the fins are positioned in the "DOWN" position.
Figure 17B:
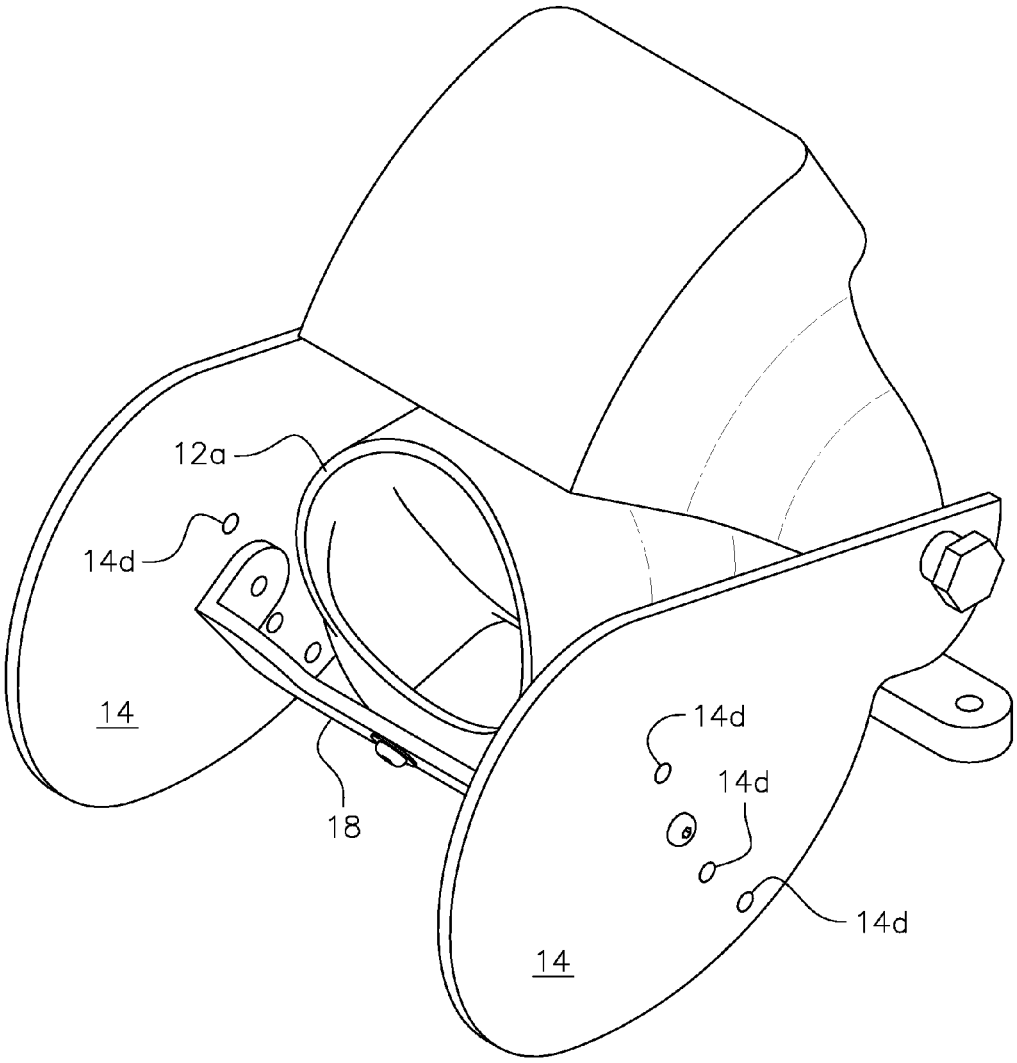
FIG. 17B is a conceptual depiction of the invention of FIG. 17B where the fins are attached directly to the ends of the stabilizer member, in this case, the fins are positioned in one of the one or more "INTERMEDIATE" positions.
Figure 17C:
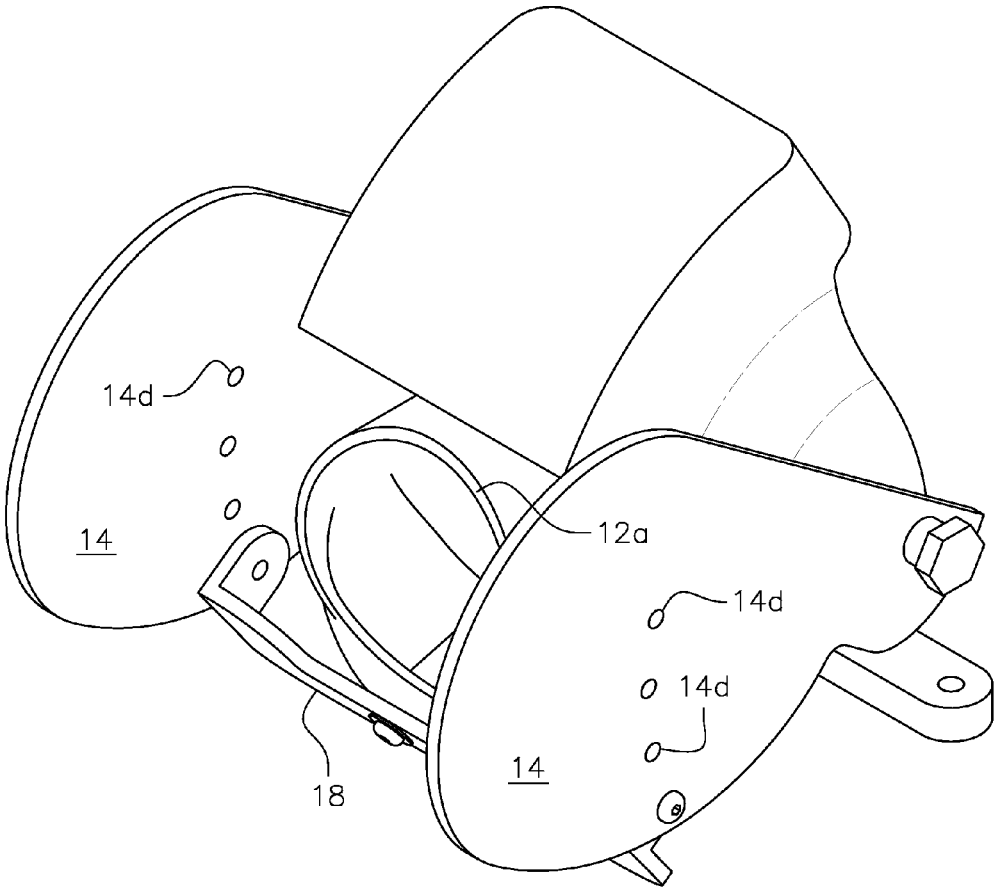
FIG. 17C is a conceptual depiction of the invention of FIG. 17A where the fins are attached directly to the ends of the stabilizer member, in this case, the fins are positioned in the "UP" position.

In another embodiment depicted in FIGS. 17A-17C, a set of variable effect rudders 14, using a fixed position side force stabilizer 18 and several graduating mounting holes 14*d* on the fins 14 that allow the consumer to vary the amount of steering assistance they receive. In this variant of the invention, the auxiliary rudder system comprises a pair of spaced-apart fins 14, the fins 14 being configured to be attached at one end to a proximal end of the nozzle drive system so that the fins are oriented along sides of the nozzle drive system 12. The fins 14 extend in length from the proximal end of the nozzle drive system 12 a predetermined distance beyond a jet water flow outlet of the nozzle drive assembly 12. A side force stabilizer member 18 is configured to be fixed to an underside of the directional nozzle 12*a* of the nozzle drive system 12. The stabilizer member 18 is oriented transversely such that respective ends of the stabilizer member 18 are attached to the inside surface of the fins 14. The fins 14 are selectively attachable to the stabilizer member 18 ends such that the fins 14 are positioned in an "up" position, a "down" position and one or more intermediate positions relative to the stabilizer member using positioning holes 14*d* for selectively fastening the fins 14 to the stabilizer member 18 so that the fins 14 are in a desired orientation in relation to the directional nozzle outlet.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. An auxiliary rudder system configured for use with a jet propelled watercraft having a directional nozzle drive system, the auxiliary rudder system comprising:

a pair of spaced-apart fins, the fins being configured to be pivotally attached at one end to a proximal end of said nozzle drive system so that said fins pivot up or down along sides of said nozzle drive system;

said fins extending in length from said proximal end of said nozzle drive system a predetermined distance beyond a jet water flow outlet of said nozzle drive assembly;

a thrust operated actuator having opposing ends, each of the opposing ends of said actuator being attached to an inside surface of said fins, said actuator further having respective top and bottom surface, said actuator being dimensioned and configured to be subjected to a thrust force caused by a flow of water exiting said outlet;

a side force stabilizer member configured to be fixed to an underside of a directional nozzle of said nozzle drive system, said stabilizer member being oriented transversely such that respective ends of said member are located juxtaposed said inside surface of said fins when said fins are in a down position;

fin rotation stop means for limiting a rotation downwardly of said fins; and bias means for holding said fins in said down position, said bias means being configured to allow said fins to lift in an up position when an object is struck by said fins.

2. The auxiliary rudder system according to claim 1, wherein fin rotation stop means for limiting a rotation downwardly of said fins is a boss member attached to an inside surface of one of said fins and located so as to contact said side force stabilizer member when said fins are rotated downwardly.

3. The auxiliary rudder system according to claim 1, wherein said system further comprises means for selectively positioning a surface orientation of said actuator such that said top surface of said actuator is constantly subjected to said thrust force of water exiting said nozzle outlet to keep the fins in a down position at any speed or for pivoting and positioning said actuator orientation such that a bottom surface of said actuator is at least partially subjected to said thrust force of water exiting said nozzle outlet to lift said fins in an up position at an operating speed.

4. The auxiliary rudder system according to claim 1, wherein said actuator further comprises opposing bent portions at each end of said actuator, each of said bent portions being in contact with a respective inside surface of said fins, said bent portions of said actuator being attached to said inside surfaces of said fins.

5. The auxiliary rudder system according to claim 1, wherein said bias means for holding said fins in said down position comprises at least one spring having an extended end in contact with a top edge of one of said fins.

6. The auxiliary rudder system according to claim 4, wherein said bent portions of said actuator are pivotally attached to said inside surfaces of said fins.

7. The auxiliary rudder system according to claim 4, wherein said actuator is oriented such that said top surface of said actuator is constantly subjected to said thrust force of water exiting said nozzle outlet to keep the fins in a down position at any speed.

8. The auxiliary rudder system according to claim 4, wherein said actuator is oriented such that a bottom surface of said actuator is at least partially subjected to said thrust force of water exiting said nozzle outlet to lift said fins in an up position at an operating speed.

9. The auxiliary rudder system according to claim 1, wherein said actuator further comprises opposing bent portions at each end of said actuator, each of said bent portions being in contact with a respective inside surface of said fins, said bent portions of said actuator being pivotally attached to said inside surfaces of said fins, said bent portions having means for pivoting and positioning said actuator orientation such that said top surface of said actuator is constantly subjected to said thrust force of water exiting said nozzle outlet to keep the fins in a down position at any speed or for pivoting and positioning said actuator orientation such that a bottom surface of said actuator is at least partially subjected to said thrust force of water exiting said nozzle outlet to lift said fins in an up position at an operating speed.

10. The auxiliary rudder system according to claim 1, wherein opposing ends of said actuator are permanently fixed to said fins and said actuator is oriented such that said top surface of said actuator is constantly subjected to said thrust force of water exiting said nozzle outlet to keep the fins in a down position at any speed.

11. The auxiliary rudder system according to claim 1, wherein opposing ends of said actuator are permanently fixed to said fins and said actuator is oriented such that a bottom surface of said actuator is at least partially subjected to said thrust force of water exiting said nozzle outlet to lift said fins in an up position at an operating speed.

12. The auxiliary rudder system according to claim 1, wherein said actuator comprises means for selectively positioning the opposing ends of the actuator to the fins for orienting a desired surface of the actuator to be subjected to said thrust of water.

13. The auxiliary rudder system according to claim 1, wherein the fin rotation stop means for limiting a rotation downwardly of said fins comprises configuring the thrust operated actuator to have an extended portion on at least one end of the thrust operated actuator, wherein an edge of the extended portion comes into contact with the side force stabilizer member thereby limiting a travel of the thrust operated actuator.

14. The auxiliary rudder system according to claim 1, further comprising one or more anti-oscillating veins attached to the thrust operated actuator.

15. An auxiliary rudder system configured for use with a jet propelled watercraft having a directional nozzle drive system, the auxiliary rudder system comprising:

a pair of spaced-apart fins having respective inside surfaces, the fins being configured to be attached at one end to a proximal end of said nozzle drive system so that the fins are oriented along sides of the nozzle drive system;

said fins extending in length from said proximal end of said nozzle drive system a predetermined distance beyond a jet water flow outlet of said nozzle drive assembly;

a side force stabilizer member configured to be fixed to an underside of a directional nozzle of said nozzle drive system, said stabilizer member being oriented transversely such that respective ends of said stabilizer member are attached to the respective inside surfaces of the fins; and the fins being selectively attachable to the stabilizer member ends such that the fins are positioned in an upper position, a lower position and one or more intermediate positions relative to the stabilizer member.

* * * * *